US005983504A

United States Patent [19]

Tisbo et al.

[11] Patent Number: 5,983,504

[45] Date of Patent: Nov. 16, 1999

[54] ICE SCRAPER

[75] Inventors: Thomas A. Tisbo, Barrington, Hills; Stephen P. Whitehead, Elgin, both of Ill.

[73] Assignee: Suncast Corporation, Batavia, Ill.

[21] Appl. No.: 08/868,580

[22] Filed: Jun. 4, 1997

Related U.S. Application Data

[63] Continuation-in-part of application No. 08/455,907, May 31, 1995, Pat. No. 5,787,588, and a continuation-in-part of application No. 08/693,485, Aug. 8, 1996, Pat. No. 5,826,929.

[51] Int. Cl.[6] ..... E01H 5/02

[52] U.S. Cl. ..... 30/164.5; 30/315; 294/54.5; 294/57

[58] Field of Search ..... 294/49–51, 54.5, 294/56–60; 15/236.01, 236.02; 16/110 R, 111 R, 116 R; 30/164.5–164.8, 169, 171, 315, 329, 334, 337, 340, 344; 37/241, 265, 266, 285; 56/400.01, 400.04–400.07, 400.17; 172/13, 18, 371, 372, 380

[56] References Cited

U.S. PATENT DOCUMENTS

| | | | |
|---|---|---|---|
| D. 213,630 | 3/1969 | Hoxie | D8/1 |
| D. 214,662 | 7/1969 | Portz | D8/10 |
| D. 257,210 | 10/1980 | Bonnes | D8/10 |
| D. 267,468 | 1/1983 | Simms | D8/10 |
| D. 269,490 | 6/1983 | Germain | D8/1 |
| D. 284,733 | 7/1986 | Hozumi | D8/10 |
| D. 291,863 | 9/1987 | Kolonia | D8/10 |
| D. 296,410 | 6/1988 | Abbott | D8/10 |
| D. 306,962 | 4/1990 | Schuele | D8/13 |
| D. 328,553 | 8/1992 | Norton et al. | D8/10 |
| D. 331,652 | 12/1992 | Wu | D34/27 |
| D. 350,166 | 8/1994 | Kino | D21/120 |
| D. 360,564 | 7/1995 | Tisbo et al. | D8/10 |
| D. 363,653 | 10/1995 | Tisbo et al. | D8/10 |
| 366,099 | 7/1887 | Hinchman . | |
| D. 384,559 | 10/1997 | Tisbo et al. | D8/10 |
| D. 384,866 | 10/1997 | Tisbo et al. | D8/10 |
| D. 385,160 | 10/1997 | Tisbo et al. | D8/10 |
| 678,373 | 7/1901 | Blaser . | |
| 864,338 | 8/1907 | Schertzer . | |
| 930,660 | 8/1909 | Gifford . | |
| 964,453 | 7/1910 | Robarge . | |
| 967,270 | 8/1910 | Tiedt . | |
| 1,042,352 | 10/1912 | Kohler . | |
| 1,260,276 | 3/1918 | Miller . | |
| 1,435,061 | 11/1922 | Halsey . | |
| 1,839,285 | 1/1932 | Winkie . | |
| 1,931,349 | 10/1933 | Habig | 294/60 X |
| 3,119,596 | 1/1964 | Pratt | 254/131.5 |
| 3,177,026 | 4/1965 | Cowan | 294/54 |
| 3,474,535 | 10/1969 | Kramer | 294/49 X |
| 3,680,641 | 8/1972 | Hein | 172/371 |
| 4,149,744 | 4/1979 | Bonnes | 294/54 |
| 4,247,141 | 1/1981 | Grint | 294/49 |
| 4,280,727 | 7/1981 | Germain | 294/54 |
| 4,538,847 | 9/1985 | Lapshansky | 294/51 |

(List continued on next page.)

FOREIGN PATENT DOCUMENTS

| | | | |
|---|---|---|---|
| 234243 | 12/1959 | Australia . | |
| 2285163 | 4/1976 | France . | |
| 641210 | 8/1933 | Germany . | |
| 687817 | 1/1940 | Germany . | |
| 369590 | 3/1939 | Italy . | |
| 330961 | 6/1930 | United Kingdom | 294/57 |
| 1009947 | 11/1965 | United Kingdom . | |
| 1173714 | 12/1969 | United Kingdom . | |
| 1424565 | 2/1976 | United Kingdom . | |
| 2063142A | 6/1981 | United Kingdom . | |

*Primary Examiner*—Johnny D. Cherry
*Attorney, Agent, or Firm*—Welsh & Katz, Ltd.

[57] ABSTRACT

A user-friendly ice scraper is provided to chop and scrape ice. The sturdy ice scraper has a blade housing which holds an ice scraper blade. The blade housing can comprise a plastic blade holder with flared ribs. Advantageously, the ice scraper has a high strength composite handle with a metal core and plastic sleeve. The handle preferably includes a cap or other handgrip at its upper end.

10 Claims, 1 Drawing Sheet

U.S. PATENT DOCUMENTS

| | | | |
|---|---|---|---|
| 4,655,494 | 4/1987 | Eads et al. | 294/49 |
| 4,690,447 | 9/1987 | Adams | 294/57 |
| 4,848,073 | 7/1989 | Germian et al. | 56/400.17 |
| 4,878,704 | 11/1989 | Jacanin, Jr. et al. | 294/54.5 |
| 4,991,324 | 2/1991 | Fine et al. | 37/284 |
| 4,993,768 | 2/1991 | Ewen | 294/51 |
| 5,228,734 | 7/1993 | Pollastro | 294/54.5 |
| 5,419,600 | 5/1995 | Tisbo et al. | 294/54.5 |
| 5,435,063 | 7/1995 | Russo | 30/164.5 |

ICE SCRAPER

CROSS-REFERENCE TO RELATED APPLICATIONS

The present application is a continuation-in-part of U.S. patent application Ser. No. 08/455,907 filed May 31, 1995 now U.S. Pat. No. 5,787,588 and a continuation-in-part of U.S. patent application Ser. No. 08/693,485 filed Aug. 8, 1996 now U.S. Pat. No. 5,826,929.

BACKGROUND OF THE INVENTION

This invention pertains to snow tools and, more particularly, to ice scrapers.

Handheld portable snow tools, typically referred to as manual snow tools, are useful to remove snow, ice and slush from sidewalks and driveways. Over the years, various types of manual snow tools have been developed, such as snow shovels, snow pushers and ice scrapers.

Ice scrapers are useful to scrape, cut and chop ice from sidewalks, stairways, driveways and pavement. Smaller scrapers are useful to scrape ice from vehicle windows and windshields. Ice can accumulate on sidewalks, stairs, driveways and pavement from ice storms or from snow which has melted during the day and freezes at night when the temperature drops. Icy sidewalks, stairs, driveways and pavement can be very dangerous and slippery. It is often difficult to walk and safely drive with full control on icy sidewalks, stairs, driveways and pavements. If snow falls and accumulates on the ice, the underlying layer of ice can be treacherous.

Small amounts of snow can be readily removed from sidewalks, stairs and driveways with a snow shovel. Snow shovels are good all around snow tools. Typically, snow shovels have a generally flat blade with a very slight curvature. Snow shovels are useful to shovel, lift, raise and throw light snow away from the sidewalk, stairs or driveway. If the snow is deep, heavy, or slushy, other types of snow tools are better, safer and more productive than standard snow shovels.

Snow pushers have a rounded or curved blade which are useful to push heavy or deep snow and slush away from sidewalks and drivers. Snow pushers can be very heavy. The deep curvature of pusher blades, however, is not generally useful to lift (raise) and throw snow and slush, which remain after the bulk of the snow and slush has been pushed away.

A concern with snow shovels and ice scrapers is the strength to weight ratio. In the past, the stronger a shovel and ice scraper, the heavier it was, due to the amount of material mass required for rigidity. Previously, conventional manual snow tools were constructed with a wooden handle and a steel or iron blade or scoop. Conventional snow tools are often bulky, heavy and cumbersome to use. It has been common practice to make the shaft from wood and to rivet a section of wood to the handgrip. However, a problem with wood is that unless properly treated, water can rot the wood. Furthermore, wood can splinter and crack. While it is possible to replace the wood, it is more likely that the snow tool will be discarded.

Metal handles comprising metal shafts and/or metal handgrips, made of iron or steel have also be used. In an effort to improve the ease of use and decrease the weight of snow tools, snow tools have been made with aluminum, steel and iron handles and/or aluminum blades. Aluminum handles can be very slippery, cold and difficult to hold when wet, such as when it snows or sleets.

In modern times, part of the snow tools have been fabricated of plastic. Early snow tools with plastic blades were somewhat flimsy and did not wear well. Furthermore, snow tools with smooth, plastic rounded handles can also be slippery and difficult to hold when wet.

If the snow shovel blade or ice scraper blade is made too thin, it will bend under load and may not be suitable to adequately remove snow and ice. Furthermore, snow shovel blades and ice scraper blades are usually subjected to impact forces and abrasion during use from ice, impacted snow, the underlying pavement, salt, etc which can pit, corrode, or otherwise damage the snow shovel blade and ice scraper blade. Moreover, salt used to melt ice and water from slush and melting snow can accelerate rust and degradation of conventional iron snow shovels. Consumer often seek a large, but light weight, snow blade. For these reasons, in place of an iron or steel snow blade, some snow tools are manufactured with aluminum or plastic snow blades. While aluminum and plastic snow blades do not rust, they are much weaker and flimsier than iron and steel and often require greater thickness or metal reinforcement for greater strength to withstand the loads, forces and stresses of shoveling snow and chopping ice.

The blade, shaft and handgrip of a snow shovel and ice scraper can be constructed from plastic which does not rot, rust, or retain cold as its wood and metal counterparts. However, a problem with plastic is strength. A plastic shaft may flex causing the shaft to bend since the shaft can become a fulcrum point during use. A blade made of plastic further presents a number of problems including control of flexing and wear.

In order to manually remove snow from sidewalks, driveways and pavements, different amounts of effort are often required to remove the snow, depending on the depth, temperature, fluffiness, amounts of slush, water, ice and texture of the snow to be removed. Sometimes, women, children and older men can become overburdened and frustrated by the weight and bulkiness of a conventional ice scraper when chopping ice. Also, conventional ice scrapers can be too heavy, awkward and cumbersome to scrape ice for some women, children and older men.

It is, therefore, desirable to develop an improved ice scraper which overcomes most, if not all, of the preceding problems.

SUMMARY OF THE INVENTION

An improved ice scraper is provided to quickly, comfortably and efficiently chop, cut, scrape and remove ice from sidewalks, driveways, curbs, outdoor stairways (exterior stairs), and pavement. The attractive ice scraper is easy to use, durable and reliable. Advantageously, the user-friendly ice scraper is safer, convenient, lighter and more economical than bulky conventional ice scrapers.

In order to better grip and readily minimize slippage of the snow tool, the ice scraper has a composite handle assembly. The comfortable readily graspable composite handle assembly is operatively associated with the ice scraper blade to better and more easily grip, lift and maneuver the ice scraper and blade.

The light weight high strength, durable handle assembly can comprise a composite handle, which is operatively connected to the ice scraper blade to lift and/or push the blade. In the preferred form, the composite handle has a metal core positioned within a plastic sleeve. The metal core can be a steel, iron or aluminum pipe. The plastic sleeve or tube can encircle and annularly and peripherally surround the metal core.

The plastic sleeve can be knurled or have protuberances, ribs, raised portions, or grooves to provide manually gripping portions to enhance gripping. In one form, the plastic sleeve has finger-gripping grooves which extend substantially parallel to the axis of the sleeve and handle towards the blade.

The composite handle assembly can comprise a ribbed handle assembly with ribs or furrows. Preferably, the ribbed handle assembly comprises an extruded handle with fluting. The extruded handle can include an extruded fluted tube, shaft or shank with ridges that extend towards the blade. Desirably, the handle comprises a light-weight ribbed plastic tube which provides an easily grippable plastic sleeve that can have raised finger pads.

The light weight handle assembly can also have a plastic cap or handgrip to help push the blade and further facilitate gripping of the snow tool. The handgrip can be securely connected to the upper end of the composite tubular handle. The handgrip can also comprise a D-shaped plastic handgrip and can have finger grippable ribs. The cap or handgrip can have a textured surface as well as raised portions to enhance gripping and structural strength.

The ice scraper can have a blade assembly with a housing or bracket which provides a blade holder to hold an ice scraper blade to cut, chop, scrape, push and lift ice. The ice scraper blade can comprise a metal blade and is preferably a steel blade. In the preferred form, the blade housing comprises a plastic blade holder with ribs for enhanced strength and support. The housing can also have a socket to snugly receive the composite handle. If desired, the housing can further have gripping portions to facilitate gripping by the user's boot or shoe.

A more detailed explanation of the invention is provided in the following description and appended claims taken in conjunction with the accompanying claims.

DETAILED DESCRIPTION OF THE PREFERRED EMBODIMENT

Figures 1, 2, 3, 4, 5:
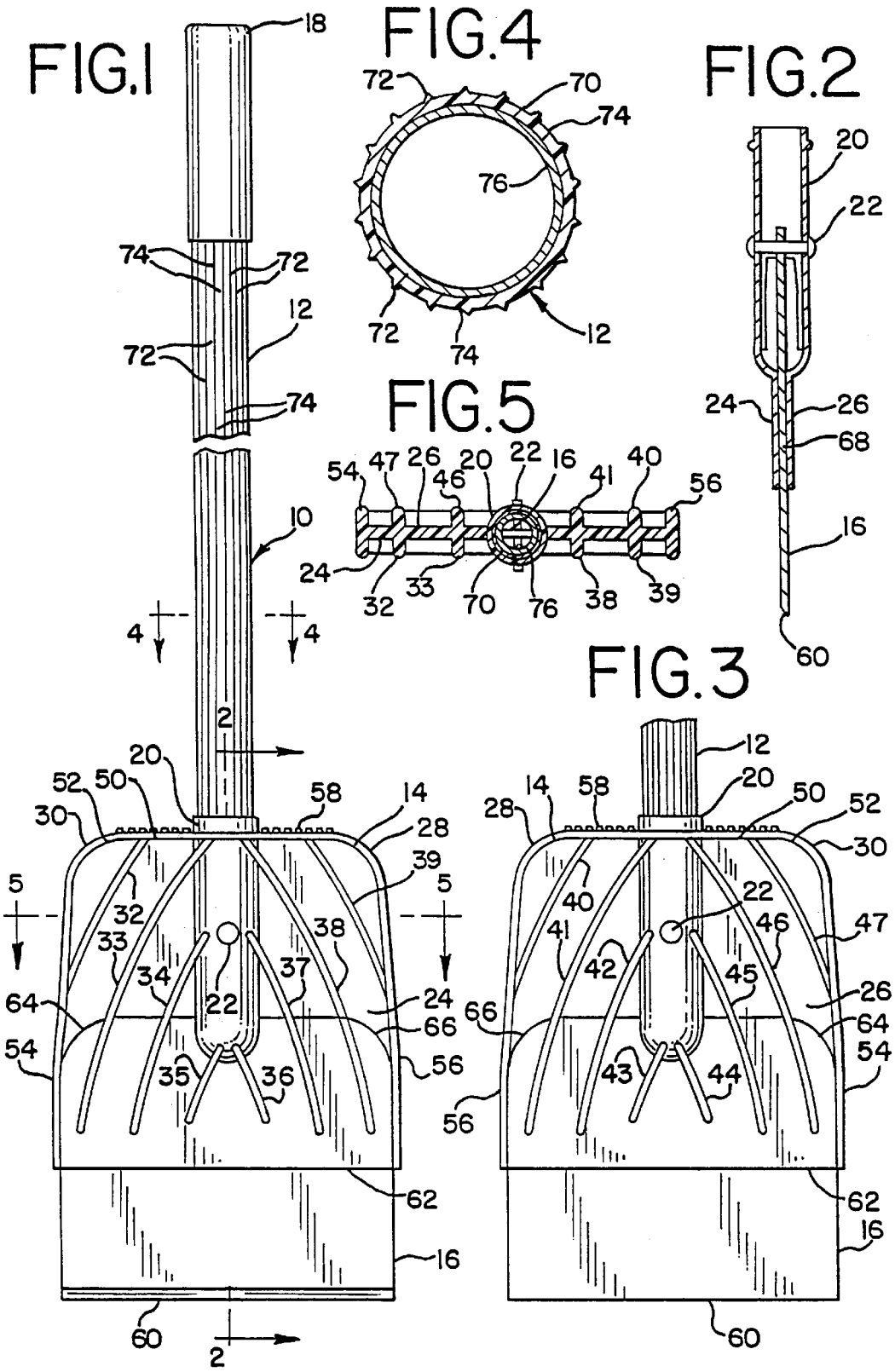
FIG. 1 is a fragmentary front view of an ice scraper in accordance with principles of the present invention.
FIG. 2 is a cross-sectional view of the ice scraper blade and blade holder taken substantially along line 2—2 of FIG. 1.
FIG. 3 is a back view of the ice scraper blade and blade holder.
FIG. 4 is an enlarged cross-sectional view of the handle taken substantially along line 4—4 of FIG. 1.
FIG. 5 is a cross-sectional view of the ice scraper taken substantially along line 5—5 of FIG. 1.

A handheld, manual, portable, ice scraper 10 (FIG. 1), also referred to as an ice scraper assembly or ice chopper, is provided to manually chop, split, cut, scrape, lift, raise and remove ice from pavements, such as sidewalks and driveways, wooden exterior stairways, concrete stairs, curbs, and pavement.

The ice scraper has an elongated composite handle assembly 12 which provides a handle and has a blade assembly comprising a plastic blade housing 14 which provides a bracket and blade holder to securely hold a metal ice scraper blade 16. The upper end of the handle is covered and connected to an elongated plastic cap 18 which provides a handgrip. The lower end of the handle snugly fits into a hand-receiving socket 20 (coupler) or coupling of the blade housing and can be secured by a fastener 22, such as a rivet.

The blade housing (blade holder) can be fabricated of impact-resistant plastic, such as polypropylene or polyethylene, or graphite - impregnated plastic. The blade housing has a generally rectangular bifurcated front surface 24 (FIG. 1) and back surface 26 with upper rounder shoulders 28 and 30. The front and back bifurcated surfaces of the blade housing can have curved, downwardly diverging, flared, symmetrical reinforcement ribs 32–39 (FIG. 1) and 40–47 (FIG. 2) to enhance the structural strength and integrity of the blade housing and ice scraper.

The ribs include: center ribs 35 and 36 (FIG. 1) and 43 and 44 (FIG. 2), inner inboard ribs 34 and 37 (FIG. 1) and 42 and 45 (FIG. 2), intermediate ribs 33 and 38 (FIG. 1) and 41 and 46 (FIG. 2) and outer outboard ribs 32 and 39 (FIG. 1) and 40 and 47 (FIG. 2). The center ribs and inboard ribs converge towards and are integrally connected to the socket (coupler) of the blade housing. The intermediate ribs are spaced between the inboard and outboard ribs and converge towards and are integrally connected to the upper horizontal edge portion 50 of an n-shaped or inverted u-shaped peripheral flange 52. The outboard ribs are spaced between the upright side edge portions 54 and 56 of the peripheral flange. The outboard ribs extend between and are integrally connected to the upper edge and side portions of the peripheral flange. The exterior surface of the upper portion of the peripheral flange can have upwardly extending raised ribs 58 comprising protuberances to facilitate gripping by the user's boots or shoes.

The metal ice scraper blade is preferably made of high impact corrosive-resistant metal, such as tempered galvanized steel. The ice scraper blade can have a chamfered lower cutting edge 60 (FIG. 1) which extends below the lower edge 62 of the blade housing. The front and back bifurcated surfaces of the blade holder can have raised portions with raised upper rounded shoulders 64 and 66. The blade snugly fits within a downwardly facing slot 68 (FIG. 2) of the raised portions between the front and back bifurcated surfaces of the blade housing (blade holder). The blade can be sufficiently long (high) to have a hole or slot through which the rivet or other fastener can pass as shown in FIG. 2.

A composite handle assembly 12 (FIG. 4) is provided to better grip the ice scraper and maneuver, push, scrape, chop and lift the blade. The handle assembly comprises an elongated tubular, manually grippable composite shaft or shank which provides an elongated straight high strength handle. The handle can comprise a ribbed fluted handle with a ribbed, plastic, resin, axially (longitudinally) lined sleeve 70 comprising an extruded fluted tube or sheath of impact-resistant plastic, such as polypropylene, polyethylene, or polyvinyl chloride. In order to enhance gripping, the tube can comprise a fluted tube with gripping portions, such as elongated, aliquotly and circumferentially spaced, parallel ribs 72 which provide longitudinally, raised, rounded convex, finger-gripping pads or ridges in the axial direction. The ribs of the tubular handle (sleeve) can be separated by elongated grooves 74 which provide finger-gripping slots or slits that extend parallel to the axis of the shaft (handle) and towards the blade and handgrip. The grooves provide parallel fluting or furrows which can extend along the entire length of the tube (handle) to further enhance gripping of the snow tool. The sleeve (tube) can have circumferential ribs and flutes (fluting) which cooperate with each other to provide convex pads. Each rib of the sleeve can be rounded and can extend for 10 degrees. The tube can be semi-rigid, yet flexible to withstand impact forces, bending and torque associated with chopping, pushing, scraping and lifting ice.

In some circumstances, it may be desirable that the sleeve have a smooth exterior surface or that other type of gripping portions be used, such as knurling, protuberances, ribs, etc.

In order to improve the structural strength, bending resistance, torsion and torque capacity of the handle, an interior metal core 76 (FIG. 4) is snugly positioned within the exterior plastic tube (sleeve). The inner core 76 is preferably hollow and tubular to decrease the weight of the handle and can comprise a steel tube or metal pipe made of steel, iron or other metal. The plastic sleeve provides a protective cover which annularly surrounds, encircles, and thermally insulates the metal core. The plastic sleeving overcoats the steel tube. The lower end of the handle telescopically fits and is positioned within and is coupled to the female handle-receiving socket (coupling) of the blade housing (blade holder). The coupling (socket) of the blade housing closes and seals the lower blade-connecting end of the tubular handle. The socket can extend above the upper horizontal edge portion of the blade holder. The upper end of the handle telescopically fits and is positioned within and is coupled to a plastic cap providing a handgrip. As can be seen from FIGS. 4 and 5, the metal core or tube 76 has a substantially constant cross-sectional shape along its length, and the sleeve 70 has a cross-sectional shape taken at any point along its length that is substantially identical to a cross-sectional shape taken at any other point along its length.

As described above, the ice scraper has a handle which provides an elongated composite shaft with a lower end inserted into the socket of a blade holder and an upper end inserted into an end cap placed thereon. The handle (composite shaft) comprises a metal tube enclosed within and surrounded by a plastic sleeve which can be slid over the metal tube, such as by a manufacturing heating process which results in the plastic sleeve securely adhering to an outer surface of the metal tube. The plastic sleeve conforms to the shape of the metal tube and is in press-fitting engagement therewith to provide a secure attachment which eliminates slippage or twisting of the sleeve in relation to the metal tube. The plastic sleeve and metal core (metal tube) can be of the same length. The end cap is placed over the upper end of the sleeve to provide a seal to prevent ice, snow and water from entering the upper end of the handle.

The blade holder is preferably constructed of plastic and has an upper edge which includes a plurality of raised ridges so as to provide a stepping surface for frictional engagement of the user's shoe or boot, should the user want to step on the ice scraper to apply additional force. The front and back surfaces of the blade holder are reinforced by ribs which are curved outwardly from the socket and handle towards the blade. The ribs can provide flexing control to the blade and can transfer load, impact forces and stresses toward the socket and center of the ice scraper so that the handle assembly can absorb the load, impact forces and applied stresses. The ribs can be located on both the front and back surfaces of the blade holder and can have a uniform depth and width. The curvature of the ribs also helps absorb stress and impact forces on the ice scraper blade. The blade can be secured along its upper end by use of a fastener, such as a rivet or screw, which extends through the front and back surfaces of the blade holder. The handle (shaft) can be inserted into the socket (coupling) of the blade holder to a position which is beneath the rivet in order that the rivet pass through the metal tube and plastic sleeve of the handle, as well as the blade holder and blade.

The present invention satisfies the need for a light weight ice scraper through provision of a blade assembly comprising a plastic blade holder which provides a plastic housing and bracket that secures a metal blade to a plastic coated metal core handle. The blade holder is reinforced with a series, set or array of curved ribs which extend and diverge downwardly from a handle coupling (socket) in the blade holder. The blade can comprise a galvanized steel tapered blade. The blade is securely held by the plastic blade holder. The blade is very strong and durable and is further strengthened by the ribs placed along the front and back surfaces of the blade holder.

The handle can be constructed from low cost steel tubing. The steel tubing (core) of the handle can be covered with a plastic sleeve which can be press fit over the metal tube during manufacturing. The plastic sleeve can be allowed to shrink to conform the sleeve to the tube to form a composite handle (shaft) which prevents slippage. In this manner, a low cost unfinished steel tube facilitates adhesion of the plastic. The result is a shaft having the high strength of steel with the advantages of plastic, namely, reduced expansion and contraction, insulation from cold metal surfaces and elimination of rusting surfaces. A plastic endcap can be fitted over the end of the shaft to seal the tube.

The ice scraper provides an ice chipper with a blade holder molded and constructed of a single unitary piece of plastic. The blade holder has a front upper surface and a back bottom surface with a pair of upright lateral edges, an upper edge and bifurcated lower edges. The blade holder has a socket which provides a centrally imposed coupling joint that is positioned between the lateral edges. The front and back surfaces of the blade holder have a series, set and array of spaced apart reinforcement ribs.

A steel cutting blade provides a blade element of nominal thickness. The upper end of the blade is insertable into the bifurcated lower edge of the blade holder. The blade has a chamfered lower end for chipping ice. A rivet provides fastening means for securing the steel blade to the bifurcated lower edge of the blade holder.

The ice scraper has a handle assembly comprising a shaft constructed from a steel tube positioned within and annularly surrounded by a plastic sleeve. The sleeve is secured in fixed relationship to the steel tube and is of a similar length as the steel tube. Preferably, the plastic sleeve is extruded from polyethylene and conforms to said steel tube (steel core) upon receipt of heat. A portion of the plastic sleeve can be knurled, ribbed, etc. to provide a gripping surface. The shaft is insertable into said coupling joint of the blade holder. A handgrip providing a cap has an opening formed at one end for insertion on a free end of said shaft.

The spaced apart reinforcement ribs of the blade holder can comprise downwardly diverging stress relief ribs positioned on the front and back surfaces of the blade holder. The ribs can be formed from narrow strips of plastic and can have a uniform height. Each of the ribs can have a longitudinal length with a lower first end spaced above and juxtapositioned near the lower bifurcated edge of the blade holder. The ribs can be directed inwardly toward the center axis of the blade holder and ice scraper.

The convenient, economical ice scraper has superior wear capabilities, which are attributable to the ribbed blade holder, the composite handle assembly, the materials used, and the overall construction, engineering design and arrangement of the parts of the ice scraper.

Among the many advantages of the inventive ice scraper are:

1. Superb performance.
2. Outstanding quality.
3. Excellent ice chipping, chopping, scraping and removal.
4. Strong.
5. Sturdy.
6. Wear resistant.
7. Attractive.
8. Safe.

9. Dependable.
10. User friendly.
11. Convenient.
12. Durable.
13. Portable.
14. Light weight.
15. Comfortable.
16. Simple to use.
17. Efficient.
18. Versatile.
19. Economical.
20. Effective.

Although embodiments of the invention have been shown and described, it is to be understood that various modifications and substitutions, as well as rearrangements of parts, components, and process steps, can be made by those skilled in the art without departing from the novel spirit and scope of this invention.

What is claimed is:

1. An ice scraper comprising:

a metal ice scraper blade for chopping, cutting and scraping ice;

a blade housing comprising a plastic blade holder for holding said blade, said blade holder having a front surface and back surface with flared ribs and defining a slot for receiving said blade, said blade extending downwardly from said blade holder, and said blade holder defining a handle-receiving socket providing a coupling;

a composite handle assembly providing an elongated composite handle for lifting and maneuvering said blade and plastic blade holder, said handle having a lower end for insertion into said handle-receiving socket and an upper end, said composite handle assembly comprising an elongated metal tube providing a metal core, said metal tube having a length and having a substantially constant cross-section and shape along its length;

an elongated plastic sleeve annularly surrounding said metal core for thermally insulating said core, said plastic sleeve having a length about equal to the length of the metal core to surround said core substantially entirely along its length and being adhered to said core, said sleeve having a cross-sectional shape taken at any point along its length that is substantially identical to a cross-sectional shape taken at any other point along its length; and a handgrip connected to said upper end.

2. An ice scraper in accordance with claim 1 including a fastener for securely connecting said composite handle to said plastic blade holder.

3. An ice scraper in accordance with claim 2 wherein:

said ice scraper blade defines a hole for receiving said fastener; and said fastener comprises a rivet.

4. An ice scraper in accordance with claim 1 wherein said handgrip comprises an elongated plastic cap.

5. An ice scraper in accordance with claim 1 wherein said sleeve comprises gripping portions.

6. An ice scraper in accordance with claim 5 wherein:

said sleeve comprises an extruded plastic fluted sleeve; and said gripping portions comprise elongated ribs extending between said lower and upper ends of said composite handle assembly.

7. An ice scraper in accordance with claim 1 wherein said plastic blade holder comprises an n-shaped peripheral flange with side portions and an upper portion extending between and integrally connected to said side portions.

8. An ice scraper in accordance with claim 7 wherein said flared ribs comprise symmetrical downwardly diverging ribs.

9. An ice scraper comprising: a metal ice scraper blade for chopping, cutting and scraping ice;

a blade housing comprising a plastic blade holder for holding said blade, said blade holder having a front surface and back surface with flared, symmetrical downwardly diverging ribs and defining a slot for receiving said blade, said blade holder having an n-shaped peripheral flange with side portions and an upper portion extending between and integrally connected to said side portions, said blade extending downwardly from said blade holder, and said blade holder defining a handle-receiving socket providing a coupling;

a composite handle assembly providing an elongated composite handle for lifting and maneuvering said blade and plastic blade holder, said handle having a lower end for insertion into said handle-receiving socket and an upper end, said composite handle assembly comprising an elongated metal tube providing a metal core;

an elongated plastic sleeve annularly surround said metal core for thermally insulating said core;

a handgrip connected to said upper end, wherein said symmetrical downwardly diverging ribs comprise curved ribs including:

outer ribs extending between and connected to said upper portion and said side portions of said peripheral flange;

center ribs extending downwardly from said socket;

inner ribs positioned between said center ribs and said outer ribs; and intermediate ribs positioned between said inner and said outer ribs.

10. An ice scraper comprising:

a metal ice scraper blade for chopping, cutting and scraping ice;

a blade housing comprising a plastic blade holder for holding said blade, said blade holder having a front surface and back surface with symmetrical downwardly diverging flared ribs and defining a slot for receiving said blade, said plastic blade holder having an n-shaped peripheral flange with side portions and an upper portion extending between and integrally connected to said side portions, said blade extending downwardly from said blade holder, and said blade holder defining a handle-receiving socket providing a coupling;

a composite handle assembly providing an elongated composite handle for lifting and maneuvering said blade and plastic blade holder, said handle having a lower end for insertion into said handle-receiving socket and an upper end, said composite handle assembly comprising an elongated metal tube providing a metal core;

an elongated plastic sleeve annularly surround said metal core for thermally insulating said core;

a handgrip connected to said upper end, wherein said upper portion of said n-shaped peripheral flange has an exterior surface with upwardly extending raised ribs providing protuberances for facilitating gripping by a user's foot or boot.

* * * * *